US010850944B2

(12) United States Patent
Fargo et al.

(10) Patent No.: US 10,850,944 B2
(45) Date of Patent: Dec. 1, 2020

(54) ELEVATOR SYSTEM SUSPENSION MEMBER TERMINATION

(71) Applicant: Otis Elevator Company, Farmington, CT (US)

(72) Inventors: Richard N. Fargo, Plainville, CT (US); Mark R. Gurvich, Middletown, CT (US); Richard J. Ericson, Southington, CT (US); Douglas E. Logan, Bristol, CT (US); John P. Wesson, West Hartford, CT (US); David Wayne Mckee, Somers, CT (US); Wenping Zhao, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 134 days.

(21) Appl. No.: 15/806,012

(22) Filed: Nov. 7, 2017

(65) Prior Publication Data

US 2018/0127241 A1 May 10, 2018

Related U.S. Application Data

(60) Provisional application No. 62/418,344, filed on Nov. 7, 2016.

(51) Int. Cl.
*B66B 7/08* (2006.01)
*B66B 7/06* (2006.01)
(Continued)

(52) U.S. Cl.
CPC ..... *B66B 7/085* (2013.01); *B66B 7/062* (2013.01); *B66B 9/00* (2013.01); *B66B 19/02* (2013.01)

(58) Field of Classification Search
CPC ..... B66B 7/085; B66B 7/062; B66B 9/00; B66B 19/02
See application file for complete search history.

(56) References Cited

U.S. PATENT DOCUMENTS 3,660,887 A * 5/1972 Davis ..... B29C 39/10 264/262
3,739,457 A * 6/1973 Davis ..... F16G 11/04 29/460
(Continued)

FOREIGN PATENT DOCUMENTS

CN 106044470 A 10/2016
EP 2878563 A1 6/2015
(Continued)

OTHER PUBLICATIONS

European Search Report Issued in EP Application No. 17200212.3, dated Apr. 12, 2018, 8 Pages.
(Continued)

*Primary Examiner* — Michael A Riegelman
(74) *Attorney, Agent, or Firm* — Cantor Colburn LLP

(57) ABSTRACT

A suspension member for suspending and/or driving an elevator car of an elevator system includes a plurality of tension members extending along a length of the suspension member including a plurality of fibers extending along the length of the suspension member bonded into a polymer matrix. A jacket substantially retains the plurality of tension members. The suspension member is configured to be deformed at a suspension member end to allow for installation of the suspension member end into a termination assembly of the elevator system. A method of installing a suspension member of an elevator system into a termination assembly includes deforming a suspension member end and reforming it to a selected shape, inserting the suspension member end into the termination assembly and curing and/or
(Continued)

hardening it, and applying a load thereto or to the socket or the wedge to secure the suspension member end in the termination assembly.

7 Claims, 11 Drawing Sheets

(51) Int. Cl.
*B66B 9/00* (2006.01)
*B66B 19/02* (2006.01)

(56) References Cited

U.S. PATENT DOCUMENTS 5,525,003 A * 6/1996 Williams ..... B29C 70/76 24/115 M
5,718,532 A 2/1998 Mower
6,578,793 B2 6/2003 Byrnes et al.
6,854,164 B2 2/2005 Bass et al.
6,957,485 B2 * 10/2005 Campbell ..... F16G 11/042 29/857
7,472,502 B2 1/2009 Gregory et al.
7,607,204 B2 10/2009 Ach
8,096,024 B2 1/2012 Smith et al.
8,789,815 B2 7/2014 Deel et al.
9,303,627 B2 4/2016 Romo et al.
9,422,134 B2 8/2016 Ikonen et al.
10,520,406 B2 * 12/2019 Starke ..... G01N 3/02
2002/0076274 A1 * 6/2002 Carlsen ..... F16G 11/048 403/314
2014/0230194 A1 * 8/2014 Moeschen-Siekmann ..... F16G 3/00 24/115 H
2015/0101889 A1 4/2015 Kere et al.
2015/0151948 A1 * 6/2015 Pelto-Huikko ..... B66B 9/00 187/254
2015/0307323 A1 * 10/2015 Zapf ..... B66B 7/062 187/411
2016/0185572 A1 * 6/2016 Lehtinen ..... F16G 11/044 187/411
2016/0221796 A1 8/2016 Puranen et al.
2016/0223445 A1 8/2016 Campbell et al.
2017/0036891 A1 * 2/2017 Lehtinen ..... B66B 7/085
2017/0066629 A1 * 3/2017 Zhao ..... B66B 7/062
2017/0066630 A1 * 3/2017 Gurvich ..... B66B 7/062
2017/0121149 A1 * 5/2017 Lehtinen ..... F16G 11/025
2018/0111795 A1 * 4/2018 Dudde ..... B66B 7/085
2018/0127241 A1 * 5/2018 Fargo ..... B66B 7/062
2018/0222721 A1 * 8/2018 Wesson ..... B66B 7/062
2019/0301088 A1 * 10/2019 Dudde ..... B66B 7/062

FOREIGN PATENT DOCUMENTS

EP 3040301 A1 7/2016
GB 2236546 A 4/1991
RU 2006718 C1 1/1994
WO 2016100775 A1 6/2016

OTHER PUBLICATIONS

Chinese Office Action for Chinese Application No. 201711077714.2, dated Apr. 14, 2020, 8 pages.

* cited by examiner

- PRIOR ART -

- PRIOR ART -

ELEVATOR SYSTEM SUSPENSION MEMBER TERMINATION

CROSS-REFERENCE TO RELATED APPLICATIONS

This application claims the benefit of 62/418,344, filed Nov. 7, 2016, which is incorporated herein by reference in its entirety.

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt, that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated, or retained in the hoistway.

Elevator rope or belt terminations used today rely on the ability to either wrap the rope or belt around a wedge, or the ability to spread the individual wires of the rope and create a knob by placing the spread wires into a socket and potting with a material such as a babbitt or epoxy-based potting compound. These typical methods do not work for suspension members that utilize tension members formed from or including unidirectional carbon fibers in a rigid matrix. In such an arrangement, the tension member will fracture if bent around a typical wedge radius, and the carbon fibers are not able to be spread and bent to be utilized in the potted arrangement. Methods of terminating the suspension member which do not require such deformation occupy significant amounts of space and require a relatively high clamping force to retain the suspension member. Such methods are prone to undertightening, resulting in slippage of the suspension member.

BRIEF SUMMARY

In one embodiment, a suspension member for suspending and/or driving an elevator car of an elevator system includes a plurality of tension members extending along a length of the suspension member including a plurality of fibers extending along the length of the suspension member bonded into a polymer matrix. A jacket substantially retains the plurality of tension members. The suspension member is configured to be deformed at a suspension member end to allow for installation of the suspension member end into a termination assembly of the elevator system.

Additionally or alternatively, in this or other embodiments the plurality of fibers are one or more of carbon, glass, polyester, nylon or aramid fibers.

Additionally or alternatively, in this or other embodiments the plurality of fibers extend continuously along the length of the suspension member.

Additionally or alternatively, in this or other embodiments one or more thermoplastic layers are positioned in the suspension member. The one or more thermoplastic layers are configured to be softened at a suspension member end to allow for deformation of the suspension member end.

Additionally or alternatively, in this or other embodiments the suspension member includes a wedge-shaped cross-section at the suspension member end.

Additionally or alternatively, in this or other embodiments the wedge-shaped cross-section is formed via the addition of additional suspension member layers at an external surface of the suspension member at the suspension member end.

Additionally or alternatively, in this or other embodiments the wedge-shaped cross-section is formed via the addition of additional suspension member layers between internal surfaces of the suspension member at the suspension member end.

Additionally or alternatively, in this or other embodiments the suspension member end is configured to be deformed by application of heat and/or solvent to the suspension member end.

Additionally or alternatively, in this or other embodiments the suspension member end is deformed by dividing each tension member of the plurality of tension members.

Additionally or alternatively, in this or other embodiments the suspension member end is deformed by selectively moving or curving tension members of the plurality of tension members into first tension members and second tension members.

In another embodiment, an elevator system includes a hoistway and an elevator car located in the hoistway. A suspension member is operably connected to the elevator car to suspend and/or drive the elevator car along the hoistway. The suspension member includes a plurality of tension members extending along a length of the suspension member including a plurality of fibers extending along the length of the suspension member bonded into a polymer matrix. A jacket substantially retains the plurality of tension members. A termination assembly is positioned in the hoistway and is operably connected to a suspension member end of the suspension member. The suspension member is configured to be deformed at the suspension member end to allow for installation of the suspension member end into the termination assembly.

Additionally or alternatively, in this or other embodiments the plurality of fibers extend continuously along the length of the suspension member.

Additionally or alternatively, in this or other embodiments the suspension member end is wrapped around a wedge of the termination assembly and the suspension member end and wedge are installed into a socket of the termination assembly.

Additionally or alternatively, in this or other embodiments the suspension member includes a wedge-shaped cross-section at the suspension member end installed into a socket of the termination assembly.

Additionally or alternatively, in this or other embodiments the wedge-shaped cross-section is formed via the addition of additional suspension member layers at an external surface of the suspension member at the suspension member end.

Additionally or alternatively, in this or other embodiments the wedge-shaped cross-section is formed via the addition of additional suspension member layers between internal surfaces of the suspension member at the suspension member end.

Additionally or alternatively, in this or other embodiments the suspension member end is deformed by dividing each tension member of the plurality of tension members.

Additionally or alternatively, in this or other embodiments the suspension member end is deformed by selectively moving or curving tension members of the plurality of tension members into first tension members and second tension members.

In yet another embodiment, a method of installing a suspension member of an elevator system into a termination assembly includes deforming a suspension member end, reforming the suspension member end to a selected shape, inserting the suspension member end into the termination assembly, curing and/or hardening the suspension member end, and applying a load to the suspension member end or to the socket or the wedge to secure the suspension member end in the termination assembly.

Additionally or alternatively, in this or other embodiments the load is applied to the suspension member end prior to curing and/or hardening of the suspension member end.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
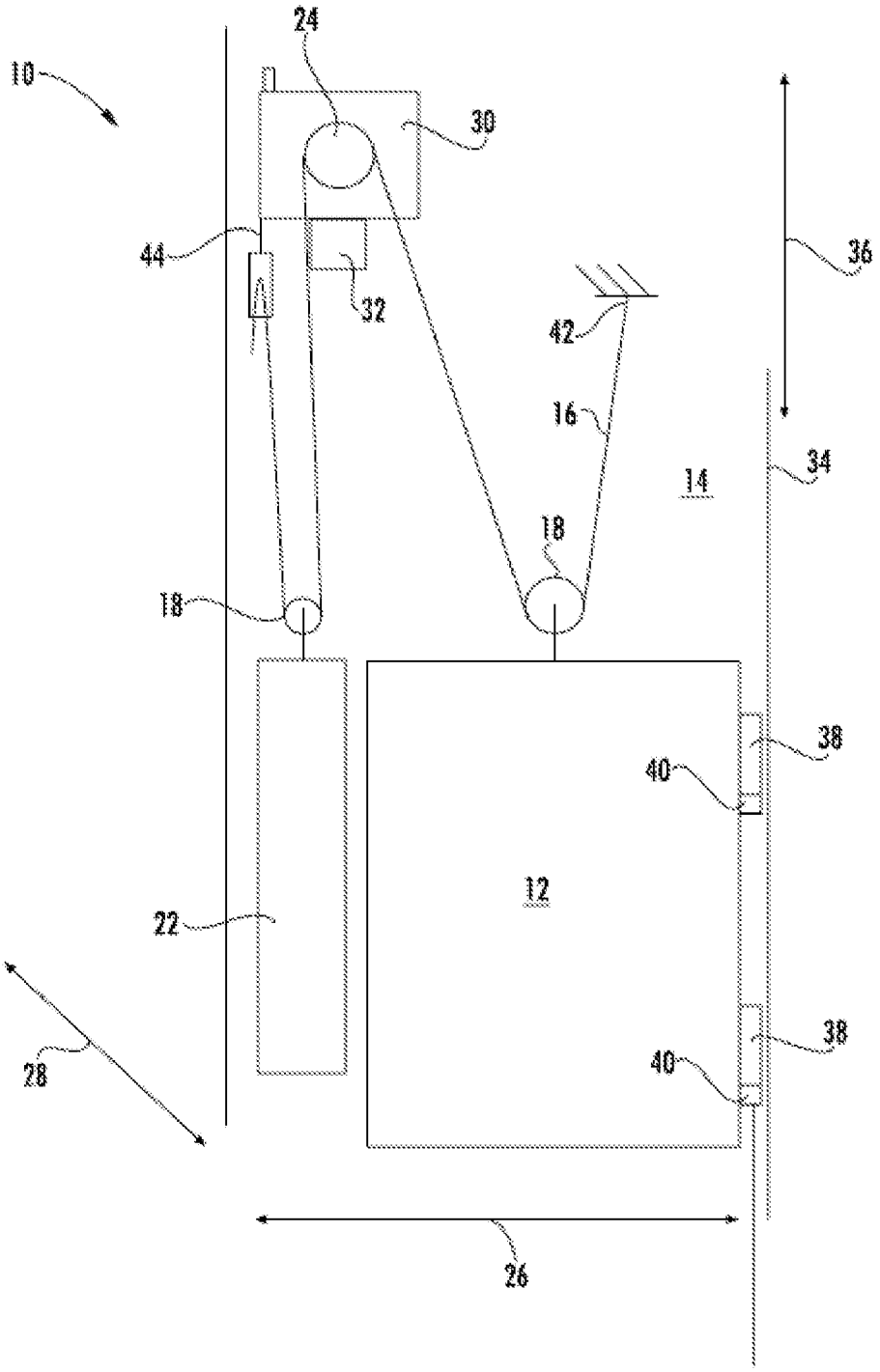
FIG. 1 is a schematic view of an exemplary elevator system.

Shown in FIG. 1 is a schematic illustration of an exemplary elevator system 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more suspension members 16 are connected to a counterweight 22, which is used to help balance the elevator system 10 and reduce the difference in belt tension on both sides of a traction sheave 24 during operation. The hoistway 14 has a width 26 and a depth 28, and in some embodiments the counterweight 22 and elevator car 12 are positioned adjacently across the width 26 of the hoistway 14.

The sheaves 18 each have a diameter 20, which may be the same or different than the diameters of the other sheaves 18 in the elevator system 10. At least one of the sheaves is a traction sheave 24 driven by a machine 30. The machine 30 is disposed at and supported by a machine bedplate 32 extending across the hoistway 14 depth 28. Movement of traction sheave 24 by the machine 30 drives, moves and/or propels (through traction) the one or more suspension members 16 that are routed around the traction sheave 24. At least one of the sheaves 18 could be a diverter, deflector or idler sheave. Diverter, deflector or idler sheaves are not driven by the machine 30, but help guide the one or more suspension members 16 around the various components of the elevator system 10.

The elevator system 10 further includes one or more guide rails 34 to guide the elevator car 12 along a vertical length 36 of the hoistway 14. The elevator car 12 further includes one or more guide shoes 38 interactive with the guide rails 34 to guide the elevator car 12, and also may include safeties 40 interactive with the guide rail 34 to slow and/or stop motion of the elevator car 12 under certain conditions, such as an overspeed condition.

Figure 1A:
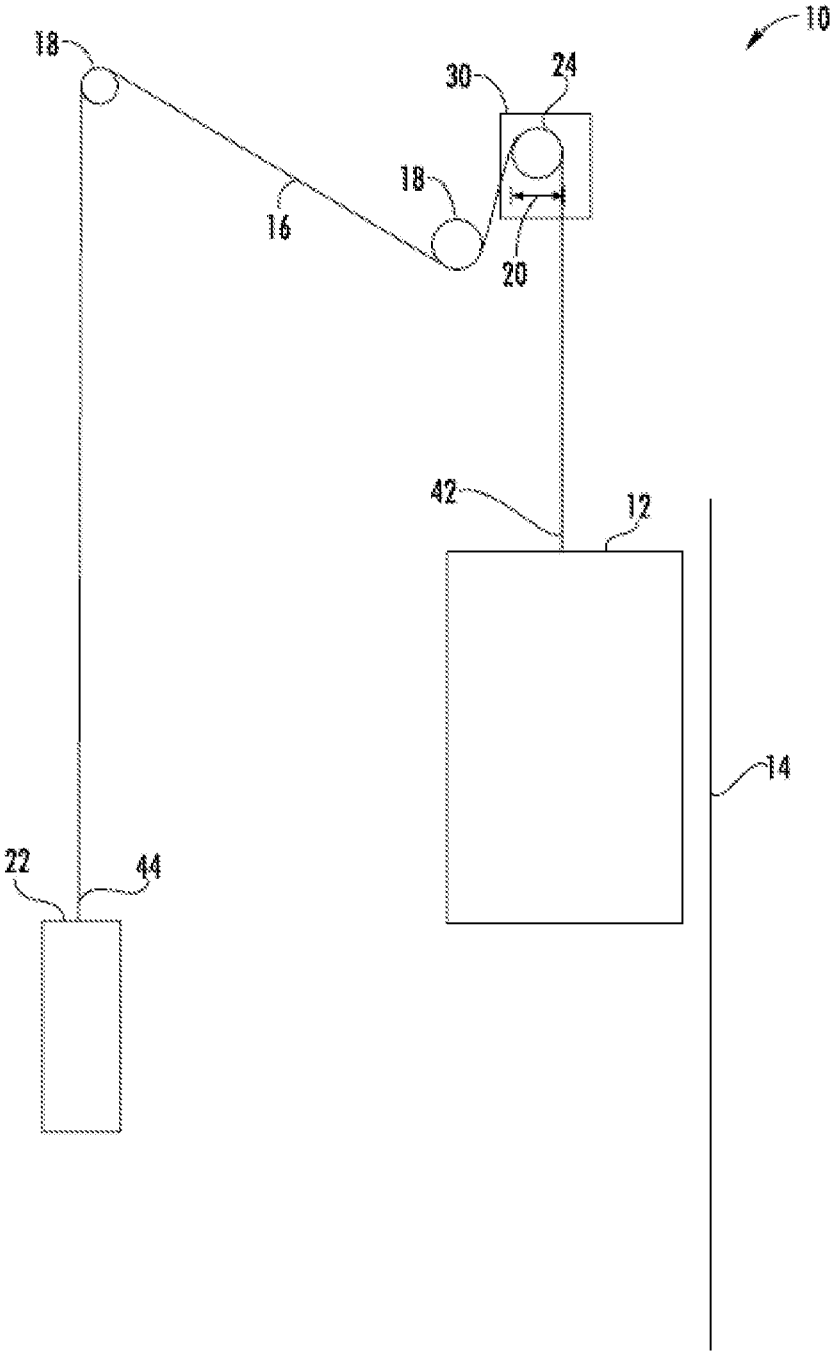
FIG. 1A is a schematic view of another exemplary elevator system.

While the elevator system 10 shown is a 2:1 roping arrangement, it is to be appreciated that elevator systems 10 with other roping arrangements, for example, a 1:1 roping arrangement such as shown in FIG. 1A, are contemplated within the scope of the present disclosure. In the embodiment of FIG. 1, the suspension members 16 terminate in the hoistway 14 at a car end termination 42 nearest the elevator car 12 and at a counterweight end termination 44 nearest the counterweight 22, while in the 1:1 roping arrangement shown in FIG. 1A, the car end termination 42 is at the elevator car 12 and the counterweight end termination 44 is at the counterweight 22.

Figure 2:
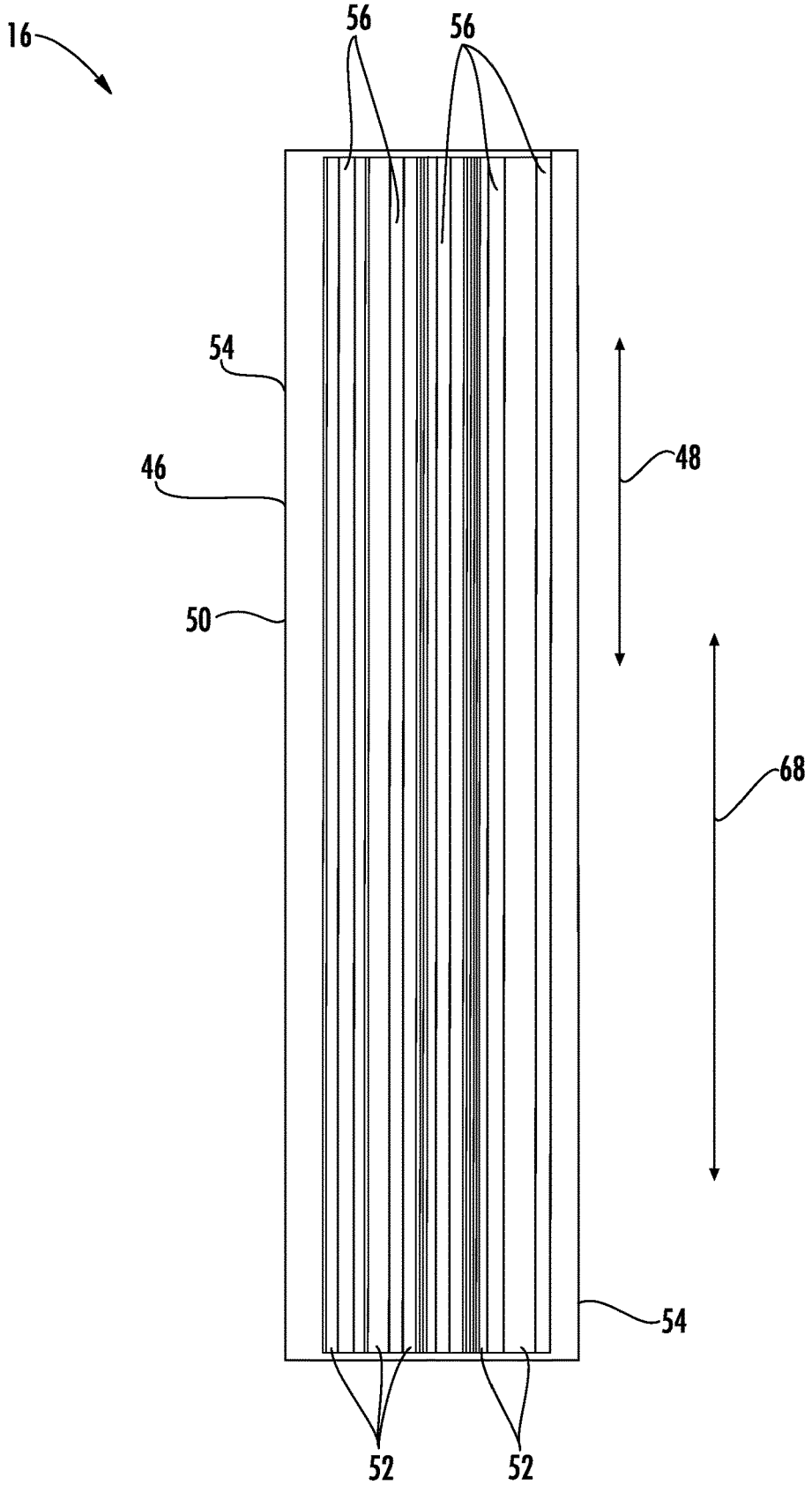
FIG. 2 is a cross-sectional view of an embodiments of a suspension member for an elevator system.

FIG. 2 provides a schematic cross-sectional view of an exemplary suspension member 16 construction or design. The suspension member 16 includes a plurality of fibers 46. The fibers 46 are continuous or discontinuous or combination of continuous and discontinuous over a suspension member length and, oriented generally such that a fiber length 48 is directed along the suspension member length 68. The fibers 46 are bonding to a polymer matrix 50 to form a tension member 52 for the suspension member 16. One or more such tension members 52 may be encased in a polymer jacket 54 to form the suspension member 16. For example, in the embodiment shown in FIG. 2, the suspension member 16 includes five tension members 52 layers encased in the jacket 54.

The fibers 46 may be formed of one or more of a number of materials, such as carbon, glass, polyester, nylon, aramid or other polyimide materials. Further, the fibers 46 may be organized into a grouping, such as a spun yarn. The matrix 50 may be formed of, for example a thermoset or thermoplastic material, while the jacket 54 may be formed from an elastomer material, such as thermoplastic polyurethane (TPU). The tension member 52 is further configured to have a fiber 46 density of 30% to 70% fibers 46 per unit of volume. In some embodiments, the fibers 46 may vary in size, length or circumference and may further be intentionally varied to provide a selected maximum fiber 46 density. The suspension member 16 further includes one or more thermoplastic material layers 56 between tension member 52 and matrix 50 layers.

Figure 3:
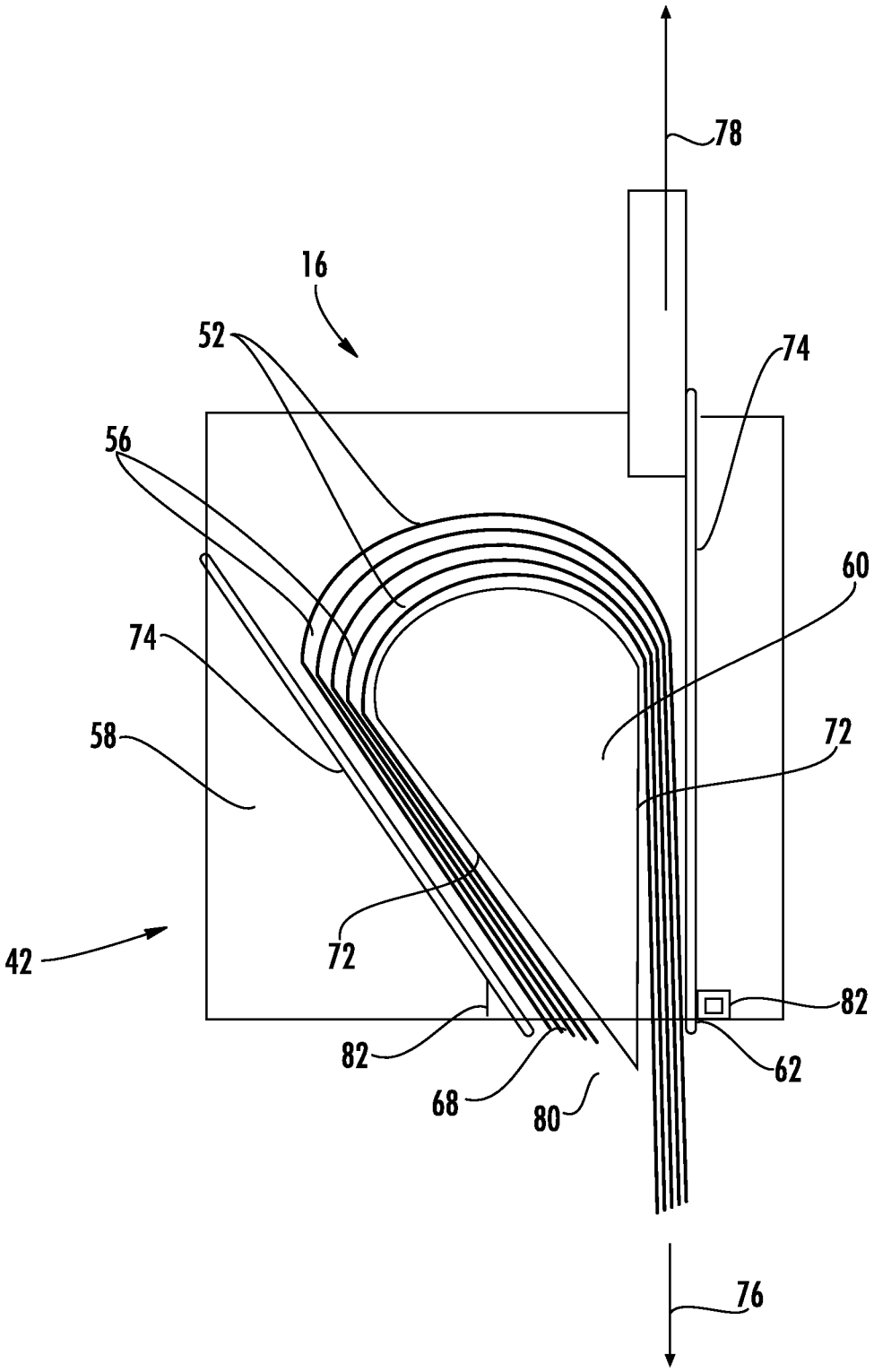
FIG. 3 illustrates an embodiment of a termination for a suspension member for an elevator system.

Referring now to FIG. 3, an embodiment of a termination 42 is shown, while it is to be appreciated that the present disclosure may be utilized at a termination 42. Termination 42 includes a socket 58 with a wedge 60 inserted thereinto. The wedge 60 has a wedge outer surface 72 that mates to a complimentary socket surface 74 of the socket 58. In some embodiments, the wedge outer surface 72 is parallel to the socket surface 74. Prior to inserting the wedge 60 into the socket 58, the suspension member 16 is inserted into the socket 58 at a socket end 62, and wrapped around the wedge 60. To enable wrapping of the suspension member 16 around the wedge 60, the thermoplastic layers 56 are softened, increasing flexibility of the suspension member 16 and therefore allowing for tightly bending the suspension member 16 around the wedge 60 without fracturing the tension members 52 or the fibers 46 included therein. In some embodiments, the thermoplastic layers 56 are softened by the application of heat, while in other embodiments the thermoplastic layers 56 are softened by application of a solvent material through, for example, soaking a selected portion of the suspension member 16 in solvent material. Once the selected bend around the wedge 60 is achieved, the softened thermoplastic layers 56, and thus the suspension member 16, is cured or hardened, a load 76 is applied to the suspension member 16 to fix the termination 42. In other embodiments, the load 76 may be applied prior to curing or hardening the softened thermoplastic layers 56.

The socket 58 has a socket exit 80 through which suspension member 16 is routed. In some embodiments, the socket exit 80 is shaped to reduce bending stresses on the suspension member 16 is the case of, for example, building sway. Additionally or alternatively, in some embodiments the socket exit includes an insert 82 of a relatively soft material to aid in reducing stresses on the suspension member 16.

Figure 4:
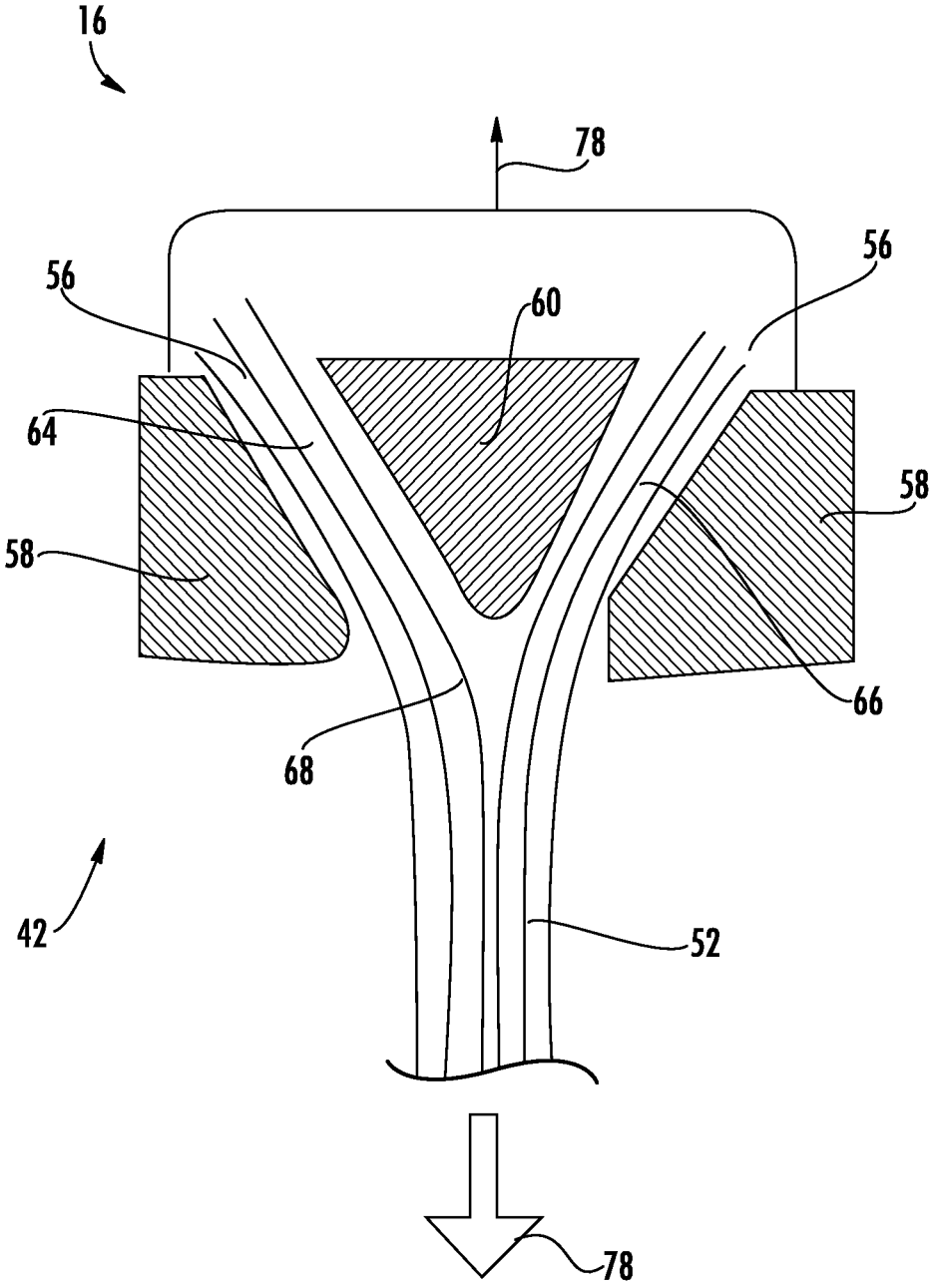
FIG. 4 illustrates another embodiment of a termination for a suspension member.

In another embodiment, as shown in FIG. 4, once the thermoplastic layers 56 are softened, the suspension member 16 is split partially along the suspension member length at, for example, a location between tension member 52 layers. The splitting of the suspension member 16 results in a first suspension member portion 64 and a second suspension member portion 66. The wedge 60 is placed between the first suspension member portion 64 and the second suspension member portion 66, after which the softened thermoplastic layers 56, and thus the suspension member 16, is cured or hardened, a load 76 is applied to the suspension member 16 to fix the termination 42. In other embodiments, the load 76 may be applied prior to curing or hardening the softened thermoplastic layers 56. As shown, a resulting reaction 78 is aligned with load 76 to avoid creating a bending moment at the termination 42.

Figure 5:
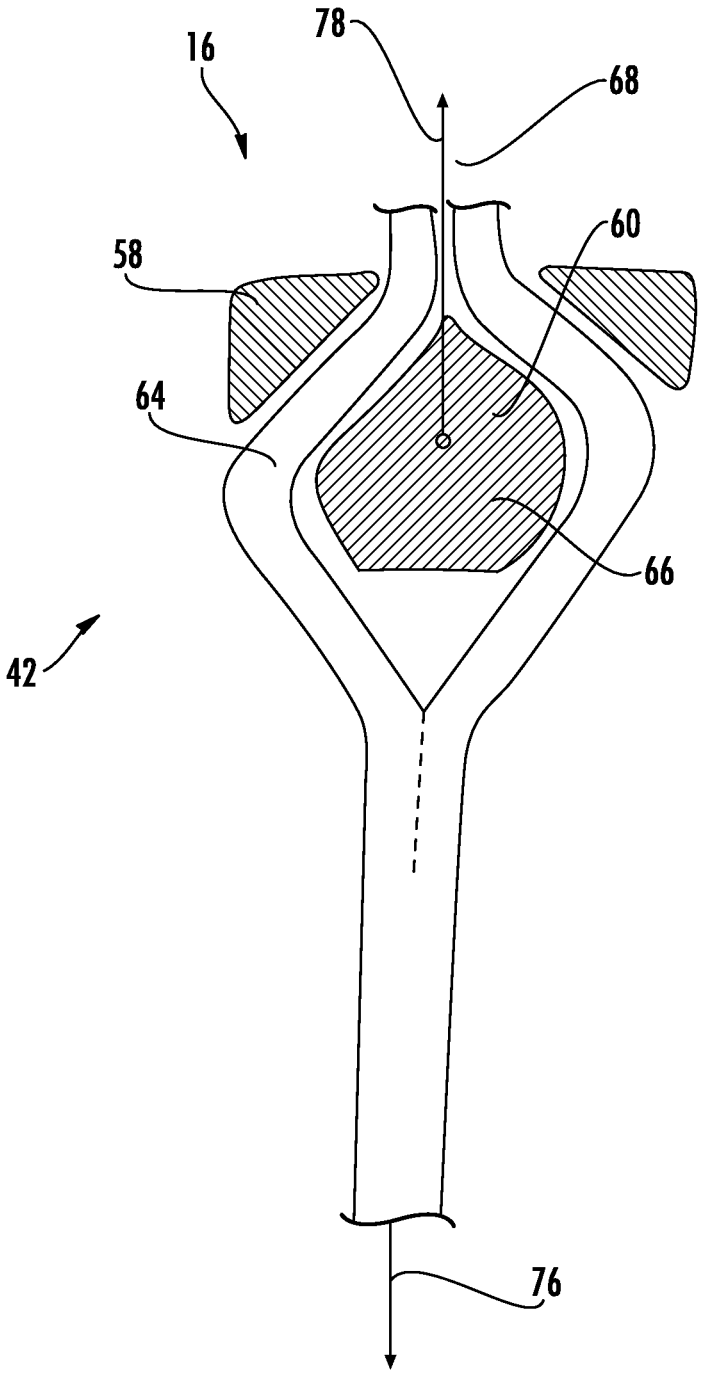
FIG. 5 illustrates yet another embodiment of a termination for a suspension member.

In another embodiment, as shown in FIG. 5, after the wedge 60 is inserted between the first suspension member portion 64 and the second suspension member portion 66, the first suspension member portion 64 and the second suspension member portion 66 are wrapped around the wedge 60, in some embodiments so the wedge 60 is enclosed in the suspension member 16. In some embodiments, the wedge 60 and the socket 58 may be mutually compressed by bolts or other mechanical means to generate through-thickness compression of portions 64 and 66. A load 76 is applied to the suspension member 16 to fix the termination 42. In other embodiments, the load 76 may be applied prior to curing or hardening the softened thermoplastic layers 56.

Figure 6:
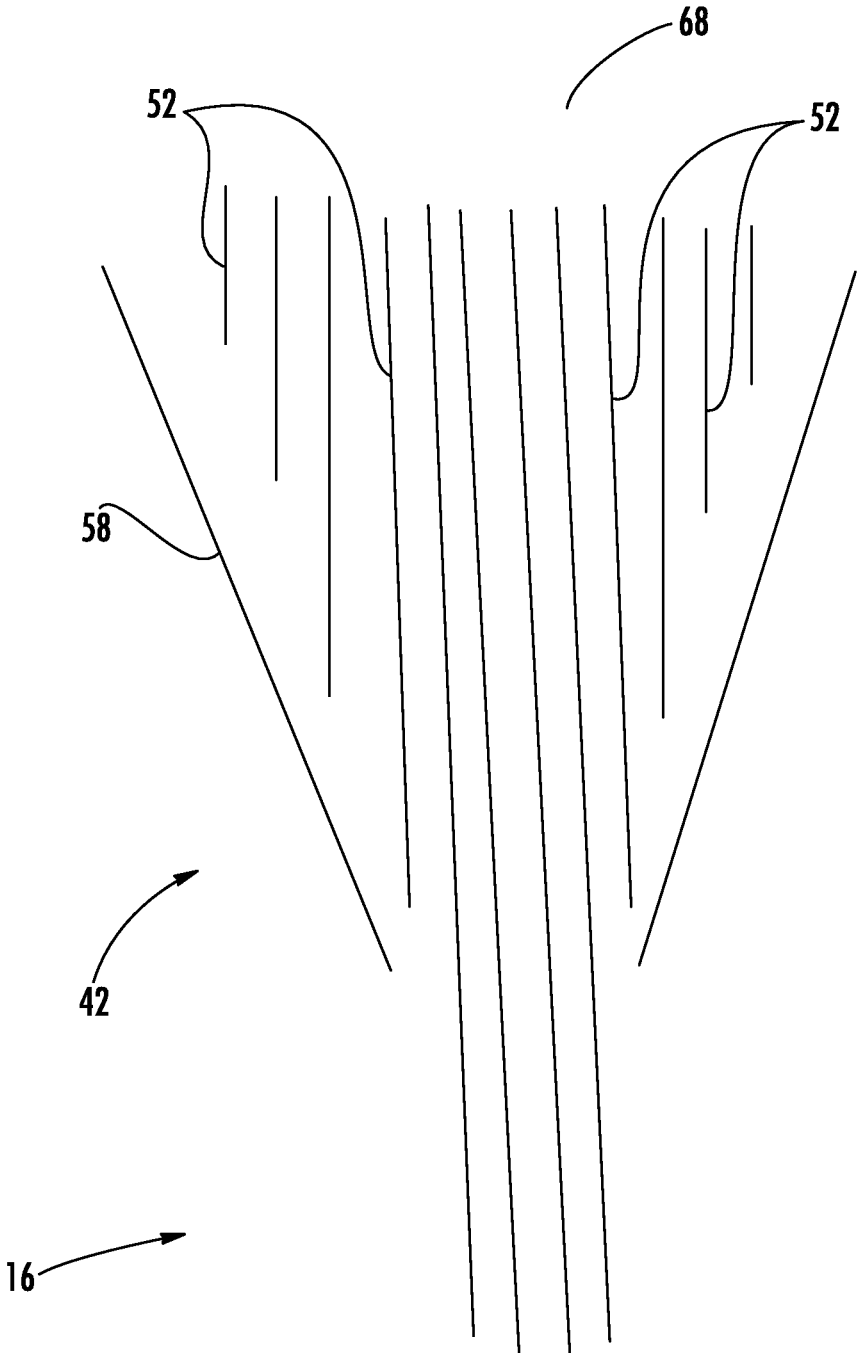
FIG. 6 illustrates another embodiment of a termination for a suspension member of an elevator system.
Figure 7:
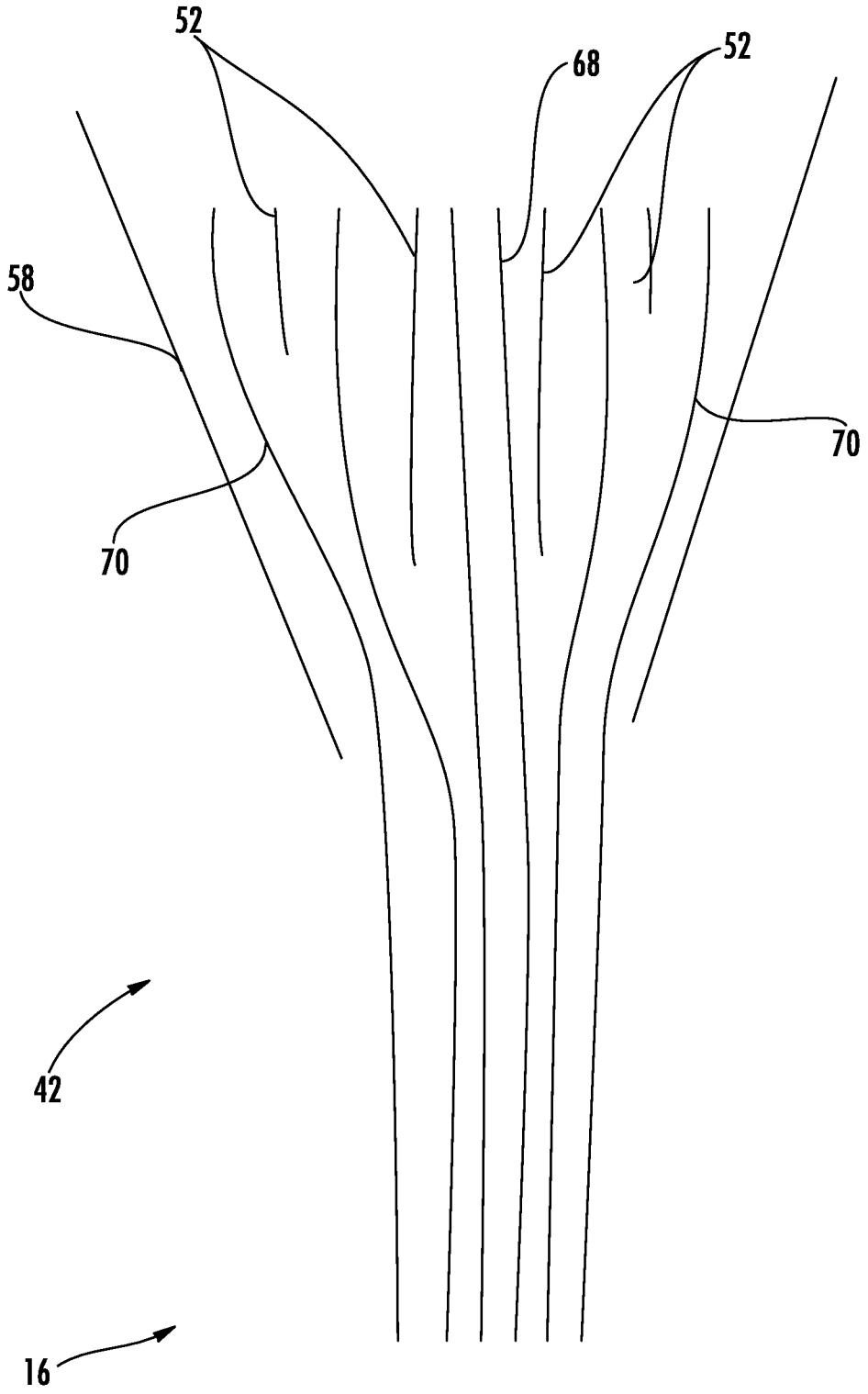
FIG. 7 illustrates still another embodiment of a termination for a suspension member of an elevator system.

Referring now to the embodiments shown in FIGS. 6 and 7, a wedge-shape is formed in the suspension member 16 itself by the addition of material plies at the suspension member end 68, which is then inserted into and retained at the socket 58. For example, as shown in FIG. 6, additional tension member 52 layers are secured to the suspension member 16, forming a selected wedge shape at the suspension member end 68. The tension member 52 layers may be bonded or cured to the suspension member 16 as shown in FIG. 6, and/or alternatively may be secured to the suspension member 16 by a plurality of mechanical fasteners, such as pins, bolts, screws or rivets. In some embodiments, such as that of FIG. 6, the wedge shape is formed by adding tension member 52 layers of successively shorter length to the suspension member 16. The additional tension member 52 layers may be cured or hardened after installation at the suspension member 16, or alternatively may be cured or hardened upon installation at the socket 58.

Referring now to FIG. 7, the wedge shape may be formed in the suspension member end 68 in other ways. For example, as shown in the embodiment of FIG. 7, additional tension member 52 layers are added at the suspension member end 68 between outer tension member layers 70 of the suspension member 16, thus the outer tension member layers 70 of the suspension member 16 are continuous along the suspension member 16 length. The wedge shape is formed by adding tension member 52 layers of successively shorter length into the suspension member 16. The additional tension member 52 layers may be cured or hardened after installation at the suspension member 16, or alternatively may be cured or hardened upon installation at the socket 58. As shown, in some embodiments the additional tension member layers 52 of shorter length may be alternated with full-length tension member layers 52 in the suspension member construction. In some embodiments the additional tension members 52 may be made of materials different than tension members 70, for example, of other fiber reinforced composites or polymer layers without fiber reinforcement or non-polymer layers such as metallic or others.

Figure 8A:
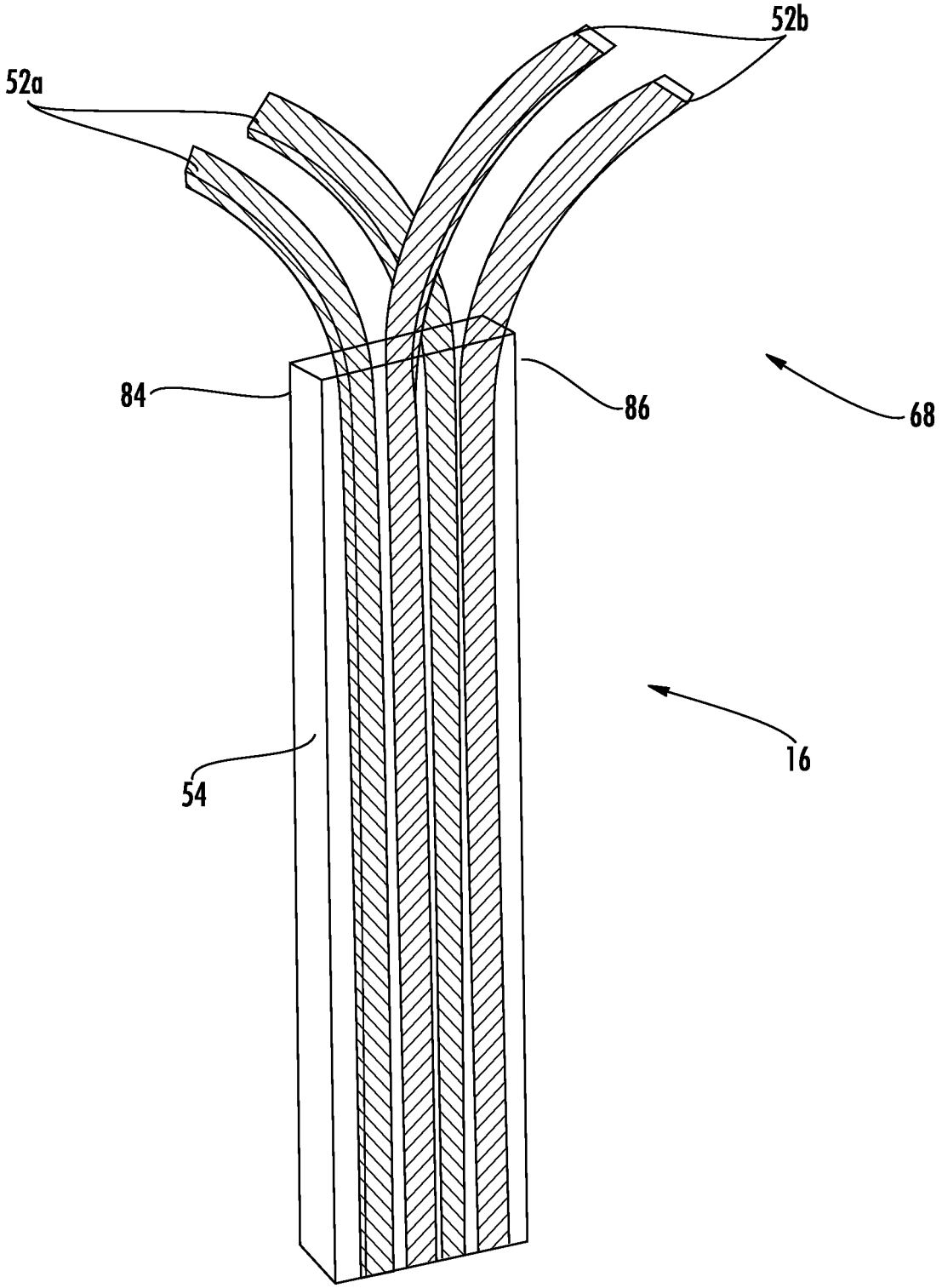
FIG. 8A is a perspective view of an embodiment of a suspension member end.
Figure 8B:
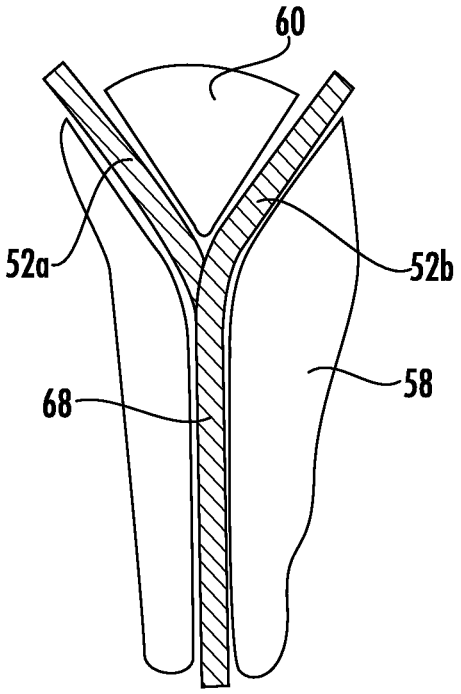
FIG. 8B is a cross-sectional view of an embodiment of a suspension member end.
Figure 8C:
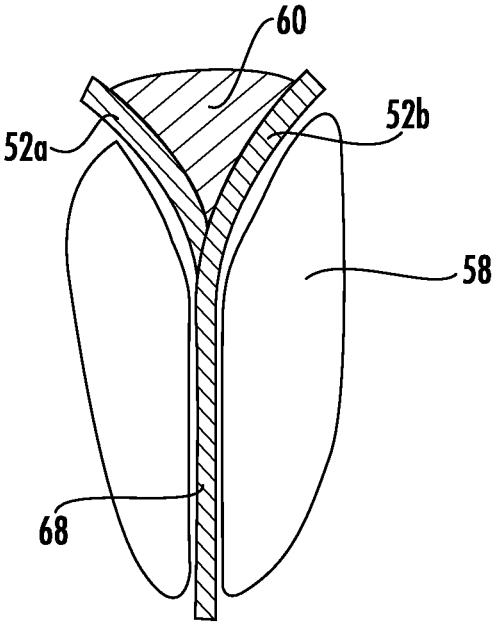
FIG. 8C is a cross-sectional view of another embodiment of a suspension member end.
Figure 8D:
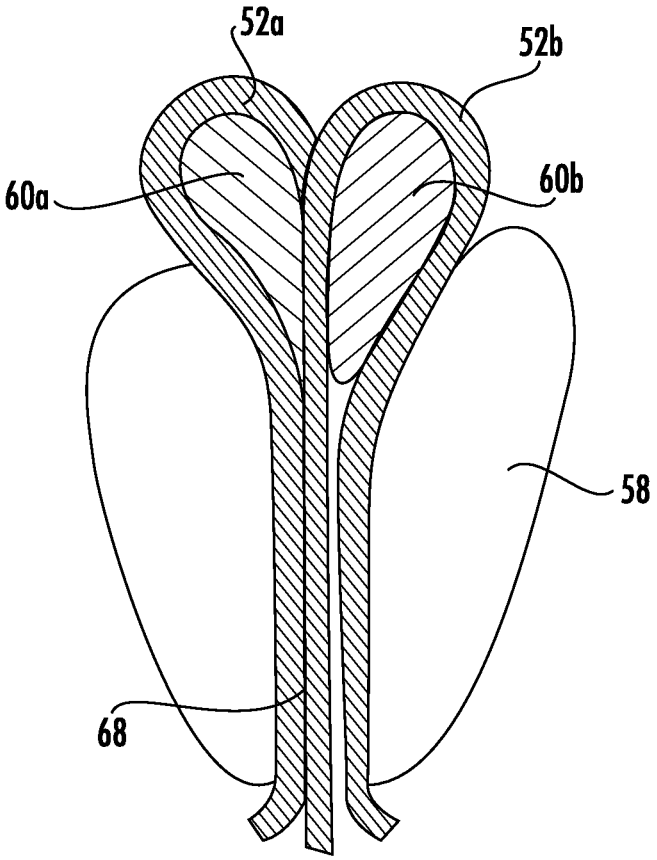
FIG. 8D is a cross-sectional view of yet another embodiment of a suspension member end.

Referring now to FIGS. 8A-8D, another embodiment is illustrated. In the embodiment shown, the jacket 54 is removed from the suspension member end 68. The tension members 52 are then selectively curved or moved toward a first lateral end 84 and a second lateral end 86. In some embodiments, the tension members 52 are alternatingly moved toward the first lateral end 84 and the second lateral end 86 to form groups of first tension members 52*a* and second tension members 52*b*. Referring now to FIG. 8*b*, the wedge 60 is inserted between the group of first tension members 52*a* and the group of second tension members 52*b*. Referring now to the embodiment of FIG. 8*c*, the wedge 60 is formed in the suspension member end 68 by adding material between the first tension members 52*a* and the second tension members 52*b*, with the additional material secured to the tension members 52 by adhesive or other means. In another embodiment, as shown in FIG. 8*d*, the first tension members 52*a* are wrapped around a first wedge 60*a*, while the second tension members 52*b* are wrapped around a second wedge 60*b*.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A suspension member for suspending and/or driving an elevator car of an elevator system comprising:

a plurality of tension members extending along a length of the suspension member including a plurality of fibers extending along the length of the suspension member bonded into a polymer matrix;

a jacket substantially retaining the plurality of tension members; and wherein the suspension member is deformed at a suspension member end to allow for installation of the suspension member end into a termination assembly of the elevator system, the suspension member having a closed wedge cross-sectional shape at the suspension member end;

wherein the suspension member includes a plurality of tension member layers, and the wedge-shaped cross-section includes additional tension member layers between internal surfaces of the suspension member at the suspension member end, such that the suspension member end includes at least one more tension member layer than the remainder of the suspension member.

2. The suspension member of claim 1, wherein the plurality of fibers are one or more of carbon, glass, polyester, nylon or aramid fibers.

3. The suspension member of claim 1, wherein the plurality of fibers extend continuously along the length of the suspension member.

4. The suspension member of claim 1, further comprising one or more thermoplastic layers disposed in the suspension member, the one or more thermoplastic layers softened at the suspension member end to allow for deformation of the suspension member end.

5. The suspension member of claim 1, wherein the suspension member end is deformed by application of heat and/or solvent to the suspension member end.

6. An elevator system, comprising:

a hoistway;

an elevator car disposed in the hoistway;

a suspension member operably connected to the elevator car to suspend and/or drive the elevator car along the hoistway, the suspension member including:

a plurality of tension members extending along a length of the suspension member including a plurality of fibers extending along the length of the suspension member bonded into a polymer matrix;

a jacket substantially retaining the plurality of tension members; and a termination assembly disposed in the hoistway and operably connected to a suspension member end of the suspension member;

wherein the suspension member is deformed at the suspension member end to allow for installation of the suspension member end into the termination assembly, the suspension member having a closed wedge cross-sectional shape at the suspension member end;

wherein the suspension member includes a plurality of tension member layers, and the wedge-shaped cross-section includes additional tension member layers between internal surfaces of the suspension member at the suspension member end, such that the suspension member end includes at least one more tension member layer than the remainder of the suspension member.

7. The elevator system of claim 6, wherein the plurality of fibers extend continuously along the length of the suspension member.

* * * * *